United States Patent [19]

Klingen et al.

[11] Patent Number: 5,076,088

[45] Date of Patent: Dec. 31, 1991

[54] DRIVE FOR A PILGER COLD ROLLING MILL

[75] Inventors: Herman J. Klingen, Schwalmtal; Josef Gerretz, Viersen, both of Fed. Rep. of Germany

[73] Assignee: Mannesmann AG, Düsseldorf, Fed. Rep. of Germany

[21] Appl. No.: 455,421

[22] Filed: Dec. 18, 1989

Related U.S. Application Data

[63] Continuation-in-part of PCT/DE87/00277, Jun. 18, 1987, Ser. No. 159,191, Feb. 3, 1988, Pat. No. 4,858,458.

[51] Int. Cl.[5] ..... B21B 21/00

[52] U.S. Cl. ..... 72/214; 72/249; 74/62; 74/591

[58] Field of Search ..... 72/208, 209, 214, 249; 74/44, 49, 52, 62, 590, 591

[56] References Cited

U.S. PATENT DOCUMENTS

| | | | |
|---|---|---|---|
| 2,924,106 | 2/1960 | Bohm et al. | 72/249 |
| 3,335,593 | 8/1967 | Zeunert | 72/249 |
| 3,584,489 | 6/1971 | Peytavin | 72/208 |
| 3,890,821 | 6/1975 | Gerretz et al. | 72/208 |
| 4,052,898 | 10/1977 | Miller et al. | 72/208 |
| 4,386,512 | 6/1983 | Rehag et al. | 72/214 |
| 4,858,458 | 8/1989 | Gerretz et al. | 72/214 |

FOREIGN PATENT DOCUMENTS

| | | | |
|---|---|---|---|
| 1945872 | 3/1971 | Fed. Rep. of Germany | 72/214 |
| 2312223 | 11/1974 | Fed. Rep. of Germany | 72/214 |
| 2740729 | 10/1979 | Fed. Rep. of Germany . | |
| 3221803 | 12/1983 | Fed. Rep. of Germany | 72/214 |
| 0592472 | 2/1978 | U.S.S.R. | 72/214 |

*Primary Examiner*—Lowell A. Larson
*Assistant Examiner*—Thomas C. Schoeffler
*Attorney, Agent, or Firm*—Nils H. Ljungman

[57] ABSTRACT

A drive for a pilger cold rolling mill which includes a crankshaft and a connecting rod. The connecting rod provides a balancing or equilibrium of moments while the crankshaft provides a balancing or equilibrium of mass.

16 Claims, 5 Drawing Sheets

DRIVE FOR A PILGER COLD ROLLING MILL

CROSS-REFERENCE TO RELATED APPLICATIONS

This application is a continuation-in-part application of international application PCT/DE87/-00277, filed June 18, 1987, in which the United State was designated and elected and is now abandoned and U.S. application Ser. No. 159,191, filed Feb. 23, 1988, now U.S. Pat. No. 4,858,458, issued Aug. 22, 1989.

BACKGROUND OF THE INVENTION

1. Field of the Invention

The invention relates to a drive for a pilger cold rolling mill in which a balancing or equilibrium of mass and a balancing or equilibrium of moments are provided by the connecting rod and crankshaft of the mill.

2. Description of the Prior Art

German Laid Open Patent Appln. No. 27 40 729 discloses a pilger cold rolling mill in which the drive of a crankshaft is attached in an offset manner to the side of the rolling mill. The crankshaft is connected by means of a crank offset for balancing the mass and for balancing the moments of the crank drive. The mass has a phase quadrature of 90 degrees in relation to the crankshaft. The back and forth movement of the crankshaft is accomplished through a parallel guide apparatus. The rolling mill is coupled to a drive mechanism by means of a long connecting rod which is located at the offset at one side of the crankshaft.

OBJECT OF THE INVENTION

It is an object of the invention to develop a compact, cost-effective construction of the drive mechanism for a pilger cold rolling mill which provides the least amount of stress, or force, on the mechanism. The present invention incorporates pre-existing knowledge concerning balancing of mass and balancing of moment, as used in drive mechanisms which employ two guide tracks, along with the unique apparatus of the present invention which allows one of the guide tracks to be eliminated.

SUMMARY OF THE INVENTION

The present invention provides a vertical configurated type of construction which allows the rolling stand of the mill to be engaged on one side only by the drive mechanism thereby allowing the mill to be guided on the entire gearing unit. Therefore, one of the tie rods, employed in the prior art, which connects the rolling stand with the gearing unit can be eliminated. The connecting rod engages the slide directly below the roll stand.

The mass required for the equilibrium of moment is provided by the connecting rod. In the prior art, the center of mass of the connecting rod was located beyond point D on the connecting rod. The total mass of the connecting rod is reduced to point D thereby allowing the dimensions of the connecting rod to be made small. Also, the rod may be constructed in a flat configuration.

The connecting rod has a velocity designated as $\vec{\dot{\phi}}$ and the inertia moment is designated as $\ominus$ $\mu o$. Together, they contribute to an improved uniformity of operation of the total system. By properly configuring and positioning the connecting rod, the center of mass, and the plane of the equilibrium of moments, the equilibrium of mass and the rolling stand are brought together as close as possible. With this configuration, one can achieve a compact construction which applies relatively little stress, or force, within the gearing unit.

With the present invention, a slide guide and a constraint guide are positioned almost on the same plane. With this configuration, only one constraint guide is needed. The constraint guide is utilized only in the final positioning of the roll stand to maintain the proper direction of the connecting rod and crankshaft. By locating the connecting rod on the crankshaft, an optimal position for the geometric arrangement and for the stress of the bearings and the journal is achieved.

Another embodiment of the invention provides planetary crank gearing (PKG). The structure of the PKG is almost identical to the earlier described embodiment which provides double slide guide gearing (DG). The difference with the DG is that the constraint guide is eliminated. The constraint guide is replaced by planetary gears which consist of a pinion and an internal gear. The pinion is firmly attached to the crank journal and, by the rotary movement of the crank, rolls off to the outer internal gear. Through the overlapping of the rotary motion of pinion and crank, there is an exact opposite sense of direction of the connecting rod.

The following is a comparison describing the disadvantages of the conventional, prior art DG and the advantages of the DG and PKG according to the present invention.

| Comparison: | |
|---|---|
| Conventional DG | DG and PKG according to the present invention |
| Horizontal construction requires a push or connecting tie rod | Due to the vertical and asymmetrical construction, no tie rods are required. |
| The large distance between the center of mass planes result in high stress of the bearing and journals | The mass required for the equilibrium of mass is furnished by the mass of the connecting rod. |
| expensive bearings are required for crank connecting rod equilibrium of moment and rolling stand | The increased inertia moment of the connecting rod contributes to the improved uniformity of operation of the entire system. |
| | Center of mass of the connecting rod goes beyond point D. The mass which has been reduced to point D reduces the total mass and the construction height of the connecting rod. connecting rod. |
| | The center of mass and moments of the connecting rod and that of the rolling stand are relatively close to each other. Therefore, the stress of the bearings and journals is reduced. |
| | By employing only one constraint guide, the requirement of accuracy for both guides relative to each other is omitted. There is no storage or discharge, respectively of potential energy because gravity does work in the direction of the main rotary axis. |
| | By employing PKG, the entire constraint guide may be omitted. |
| | The guidance of the connecting rod within the constraint guide is |

-continued

| Conventional DG | Comparison: DG and PKG according to the present invention |
|---|---|
| | accomplished by a guide roller. The number of bearings is reduced from 12 to 5. |

BRIEF DESCRIPTION OF THE DRAWINGS

The following detailed description of the preferred embodiments may be better understood when taken in conjunction with the appended drawings in which.

DESCRIPTION OF THE PREFERRED EMBODIMENTS

Figure 1A:
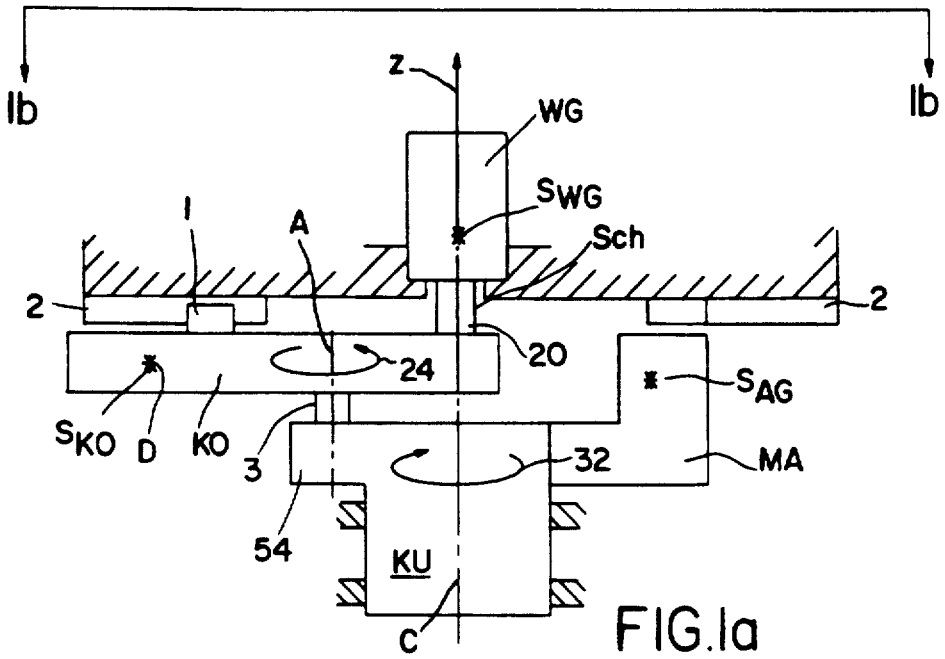
FIG. 1*a* is a side elevational view of a pilger rolling mill which employs the present invention.

As shown in the drawings, rolling stand WG can be moved in slide guide Sch. Journal 20, which rotates on bearing 22, connects roller stand WG with connecting rod KO. Connecting rod KO is located below roller stand WG and rotates around vertical axis A in the direction of arrow 24.

Figure 1B:
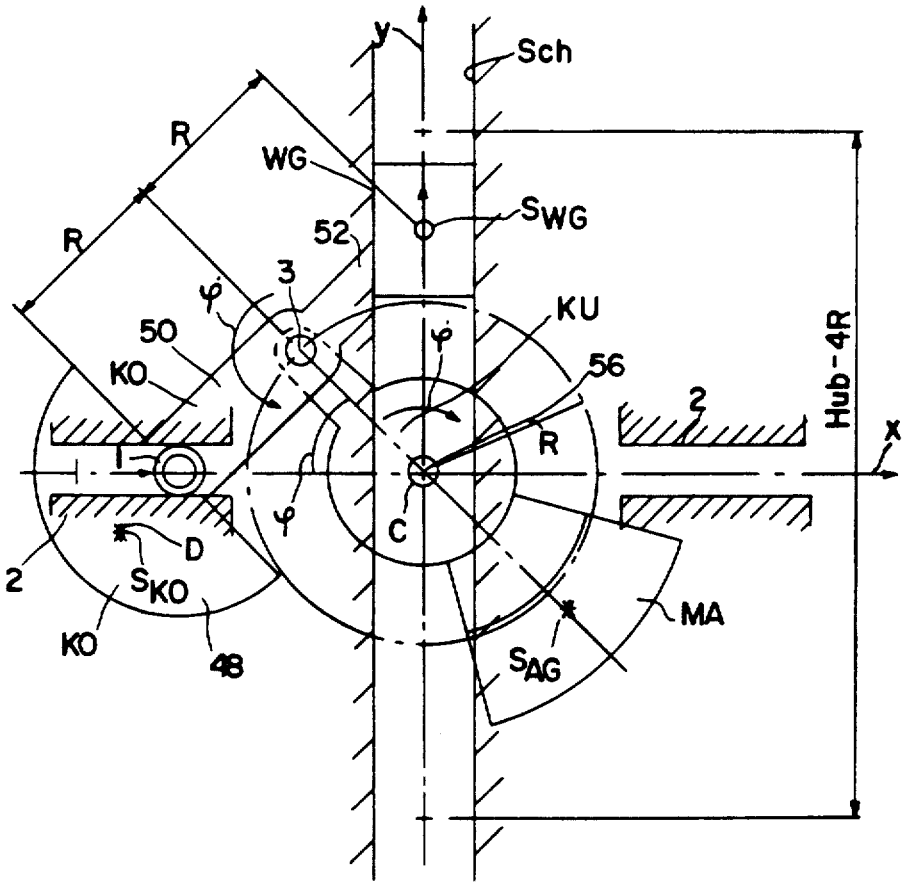
FIG. 1*b* is a top view of the device of FIG. 1*a* taken along line 1*b*—1*b*.
Figure 2:
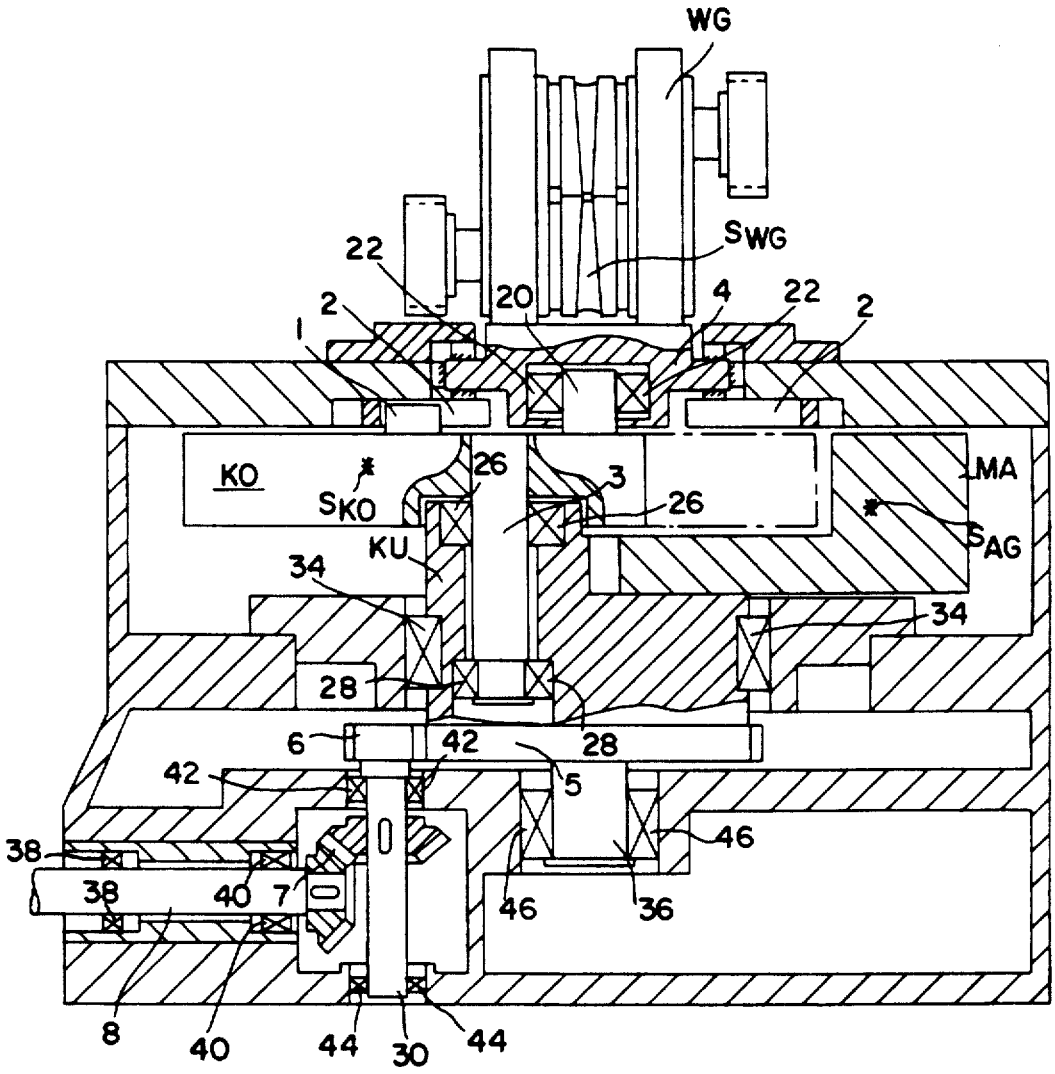
FIG. 2 is a side elevational view, partially in section, of the apparatus of FIG. 1*a*.

An can be seen in FIGS. 1*a*, 1*b* and 2, connecting rod KO includes guide roller 1 which guides connecting rod KO in constraint guides 2. Constraint guides 2, however, are, generally, only used when finally positioning guide roller 1 or connecting rod KO. Connecting rod KO is connected to crankshaft KU by means of crank journal 3 which rotates on bearings 26 and 28. Crankshaft KU rotates on bearing 34 in the direction of arrow 32. FIGS. 1*a*, 1*b* and 2 show the movement of crankshaft KU on axis C, which corresponds to axis z, along with the movement of connecting rod KO and slide 4 which move rolling stand WG. Reference letters x, y and z refer to a standard, three dimensional, coordinate system in which each axis is orthogonal to the others. x and y define a horizontal plane, while z defines a vertical axis perpendicular to the plane defined by axes x and y. $S_{WG}$, $S_{KO}$ and $S_{AG}$ represent the center of the mass of rolling stand WG, connecting rod KO and counterbalance mass MA respectively. $\phi$ and $\phi$, which may be equal, represent the speed and direction of rotation of rolling stand WG, connecting rod KO and crankshaft KU. R represents the radii of the articulation between rolling stand WG, connecting rod KO and crankshaft KU. Sch represents the guide for rolling stand WG.

Rolling stand WG has its frame appropriately connected for imparting moments to the movements to the pilger cold rolling mill.

Figure 3A:
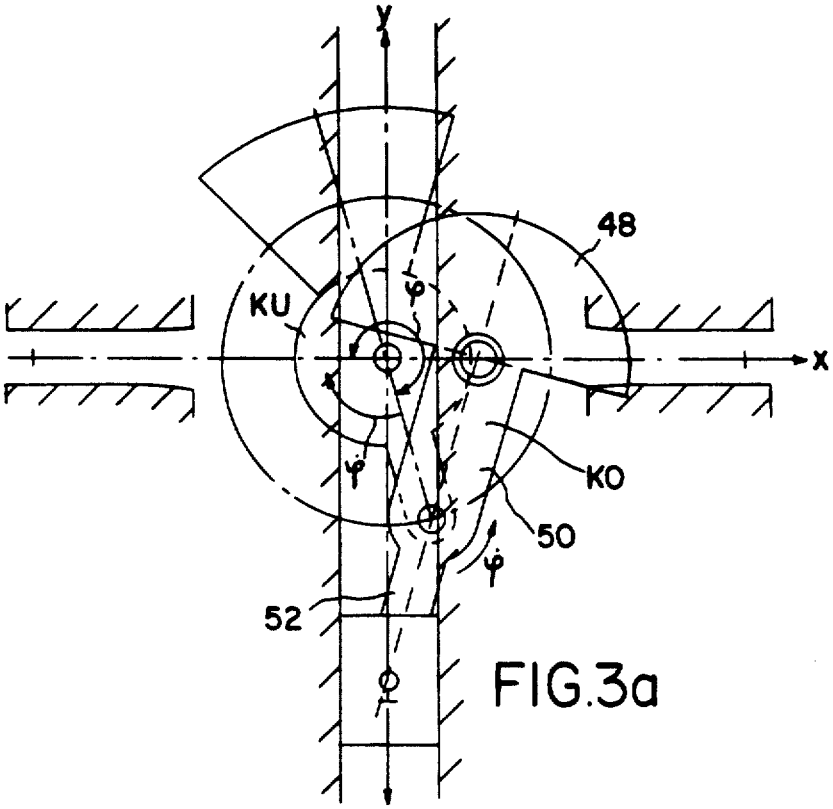
FIG. 3*a* and FIG. 3*b* are top elevational views of a pilger rolling mill, employing the present invention, showing the components of the present invention in two different relative positions.
Figure 3B:
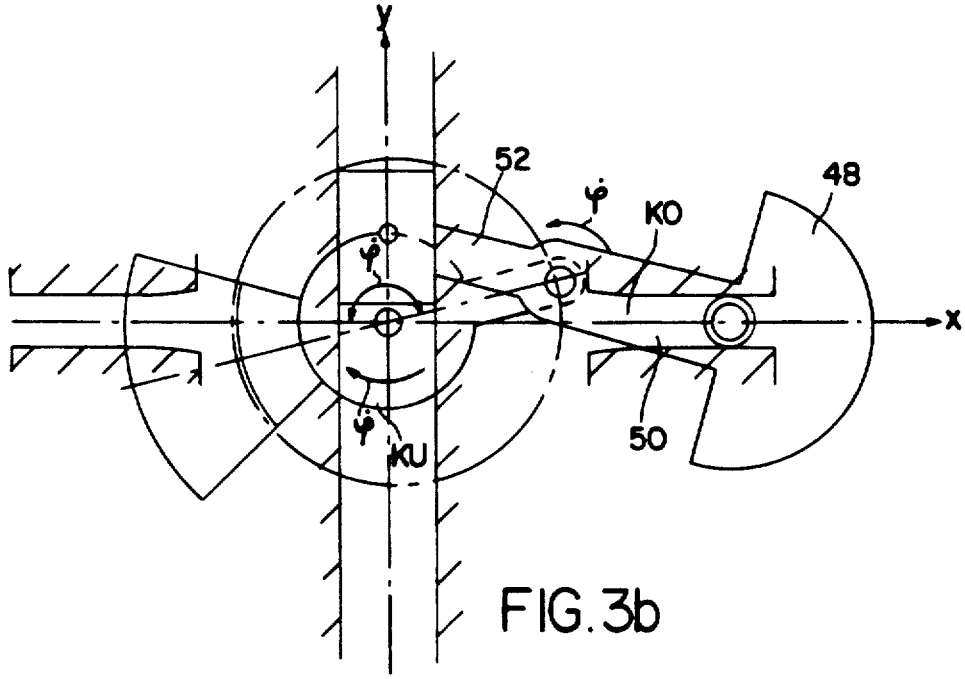

FIGS. 3*a* and 3*b* show connecting rod KO and crankshaft KU in different, relative positions. Crank shaft KU is, as shown in FIG. 2, connected by means of a corresponding gearing 5, 6, 7, 30 and 36 with drive 8. Drive 8 rotates on bearings 38 and 40. Gearing 30 rotates on bearings 42 and 44. Gearing 36 rotates on bearing 46.

As the various components, crankshaft KU, connecting rod KO and rolling stand WG move, they may maintain their common center of mass at axis C which is along axis z. Alternatively, there may be other configurations which maintain the center of mass of the arrangements balance about axis C. Such alternative configurations may be where the crank shaft KU balances the mass of the rolling stand WG.

Analogously, the center of mass connecting rod KO is positioned such that the forces of movement about the bearing or bearings is reduced to a relatively low value. This bearing of bearings may be positioned to guide rotation about axis C.

As can be seen from FIGS. 1*a*, 1*b*, 2, 3*a* and 3*b*, connecting rod KO may, if desired, balance the moment of inertia caused by connecting rod KO and rolling stand WG about journal 3. As can be seen from the figures, connecting rod KO may be appropriately configured to be disc shaped when viewed from the side. From the top, connecting rod KO has the appearance of a semicircle 48 attached to a narrowed down arm portion 50, between semi-circle 48 and journal 3, which is further attached to a more narrower arm portion 52 between journal 3 and journal 20. The shape of connecting rod KO allows both the moment of inertia of the combined connecting rod KO and rolling stand WG as well as possibly the mass of the combination to be balanced around journal 3.

Crankshaft KU is provided to shift the center of mass of the combination of connecting rod KO and rolling stand WG from journal 3 to axis C without affecting the equilibrium of moment of connecting rod KO and rolling stand WG. As seen in the figures, crankshaft KU includes counter-balance mass MA which, from the top, takes on the appearance of a portion of a sector. The remaining portion of crankshaft KU may be cylindrical and include extension 54 which is connected to journal 3. With this configuration, the center of mass of the combination of connecting rod KO, rolling stand WG and crankshaft KU appears at point 56 which is on axis C.

As shown in the figures, crankshaft KU is positioned, in an offset manner, below connecting rod KO. Likewise, connecting rod KO is positioned, also in an offset manner, below rolling stand WG.

As shown in FIG. 1*b*, the distance between $S_{WG}$ and journal 3, which is equal to R, is equal to the distance between journal 3 and guide roller 1. Point $S_{KO}$ is along the line defined by point $S_{WG}$, journal 3 and guide roller 1, but is a farther distance from journal 3 than guide roller 1 is from journal 3. The distance between journal 3 and point 56 is also equal to R. Point $S_{AG}$ is positioned on the line defined by journal 3 and point 56 but is at a distance greater than R from point 56.

Figure 4A:
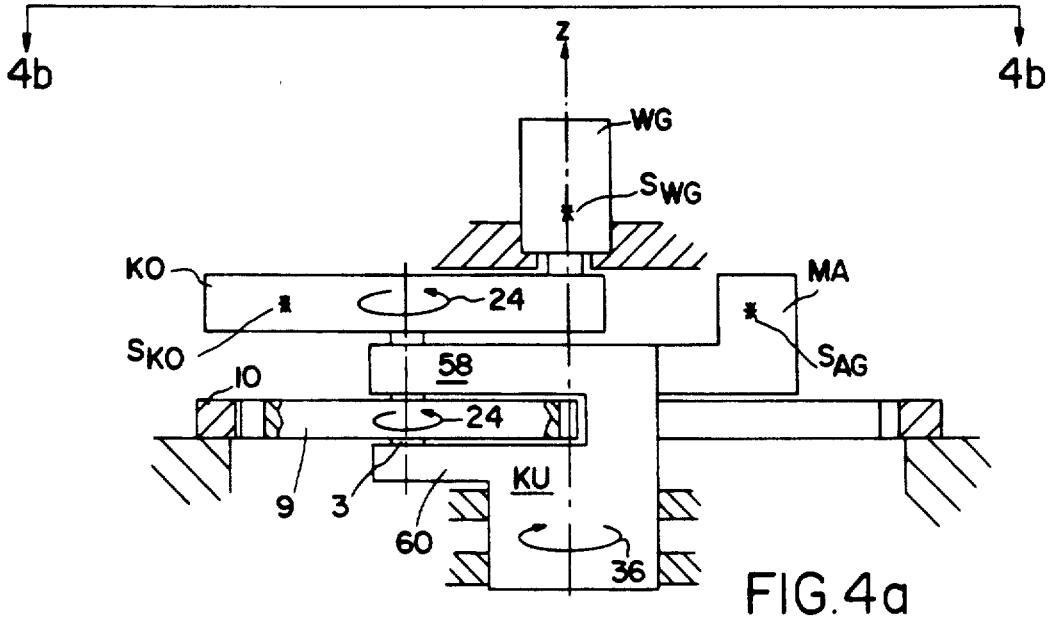
FIG. 4*a* is a side elevational view of a pilger rolling mill employing another embodiment of the present invention.
Figure 4B:
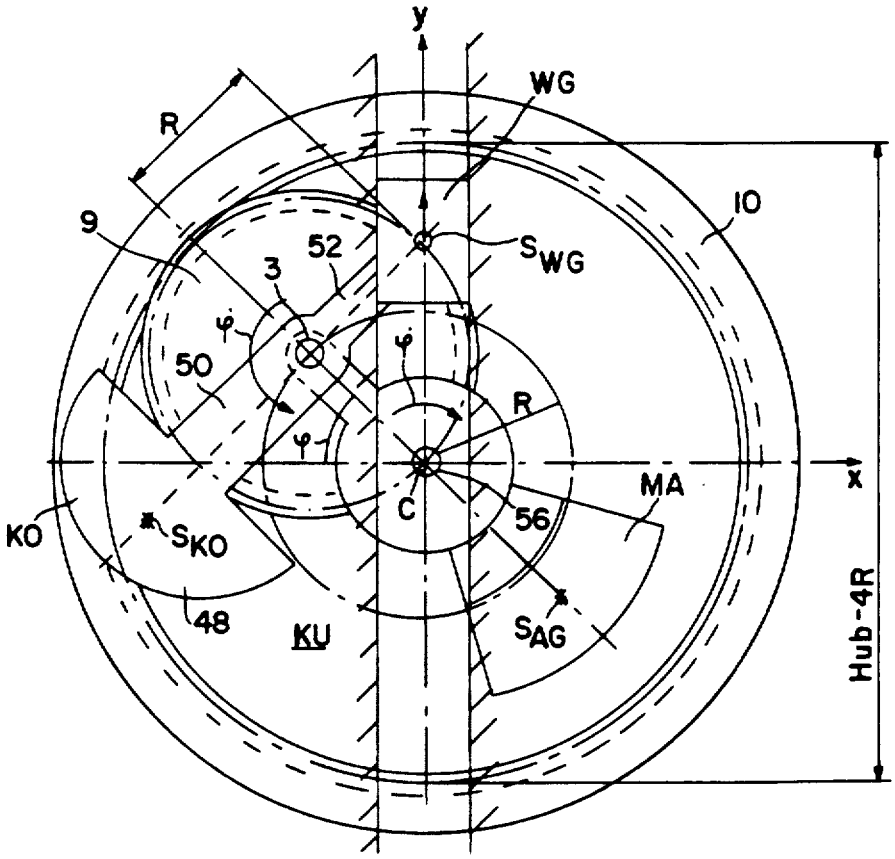
FIG. 4*b* is a top elevational view of the apparatus of FIG. 4*a* taken along the line 4*b*—4*b*.
Figure 5:
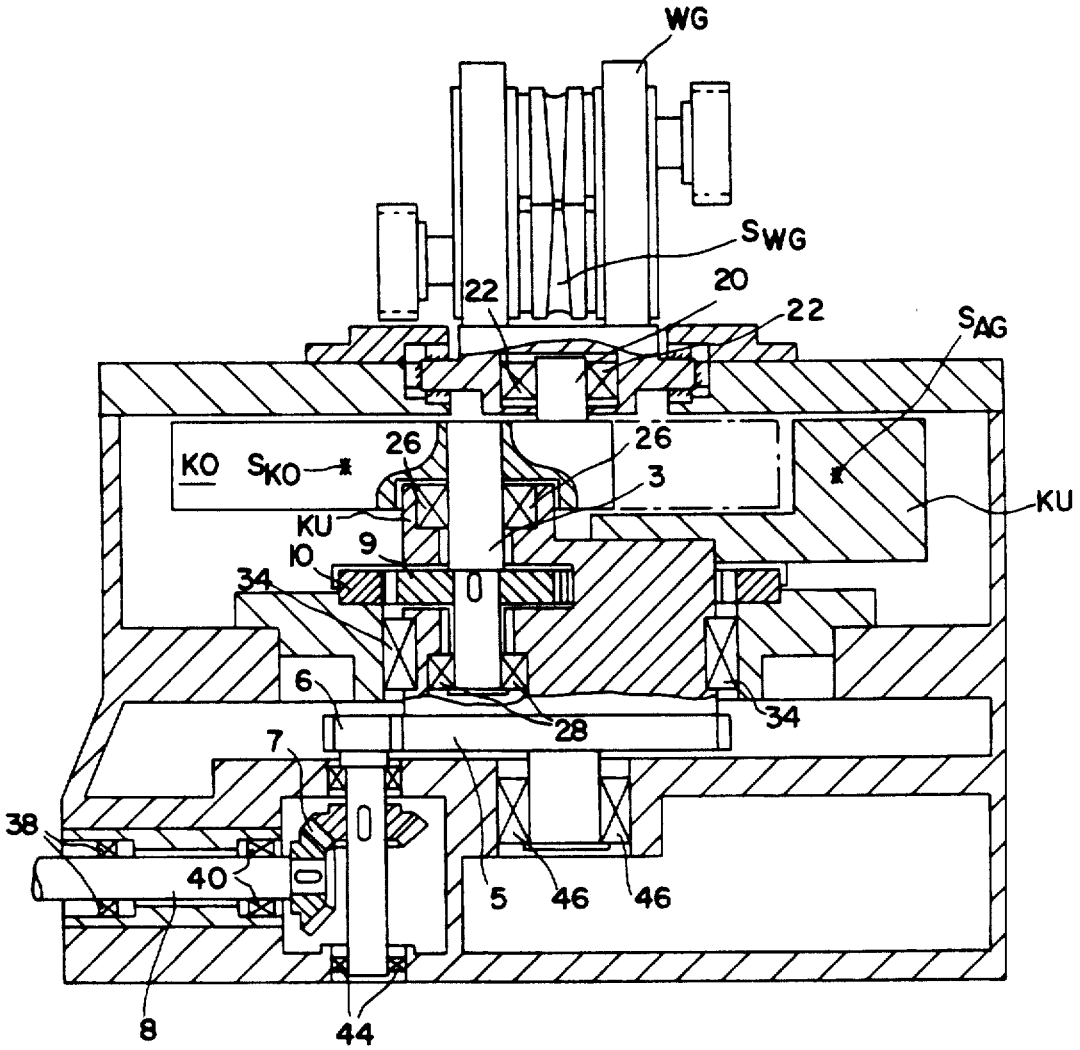
FIG. 5 is a side elevational view, partially in section, of the apparatus of FIGS. 4*a* and 4*b*.

Another embodiment of the present invention is shown in FIGS. 4*a*, 4*b* and 5. This embodiment differs from the first embodiment by employing a planetary crank arrangement instead of constraint guide 2.

Pinion 9 is solidly attached on crank journal 3 of crankshaft KU and rolls on internal gear toothed wheel 10, which surrounds crank KU. As illustrated in FIG. 4*b*, this embodiment is functional because of the overlapping movement of crankshaft KU and pinion 9, which allows connecting rod KO to move in a double motion.

In the embodiment of the invention shown in FIGS. 4a, 4b and 5, connecting rod KO, crankshaft KU and rolling stand WG are all constructed and relatively positioned the same as in the embodiment shown in FIGS. 1a, 1b, 2 and 3. The only difference between the embodiment of the invention shown in FIGS. 4a, 4b and 5 from that shown in FIGS. 1a, 1b, 2 and 3 is that a planetary gear system is employed thereby eliminating the need for guide roller 1 and guides 2. Also, the embodiment of the invention as shown in FIGS. 4a, 4b and 5 requires the employment of pinion 9 which rolls on internal gear toothed wheel 10. Pinion 9 is positioned between portions 58 and 60 of crankshaft KU. The remaining relative positioning of the parts of the invention shown in FIGS. 4a, 4b and 5 are identical to those described in the embodiment of the invention shown by FIGS. 1a, 1b, 2, 3a and 3b.

The size and shape of the various components of all embodiments of the present invention could be determined by trial and error or by employing well known equations. Counterbalance mass MA, crankshaft KU and connecting rod KO could be held to balance the moment of rolling stand WG.

One feature of the invention resides broadly in a drive for a pilger cold rolling mill with equilibrium of mass and equilibrium of moment, whereby the driven crank is connected to the rolling stand by a connecting rod, is characterized by the fact that rolling stand WG is attached immediately above the motion of crank KU and the connecting rod KO is located on crank journal 3 whereby connecting rod KO with its total mass takes care of the equilibrium of moment and crank KU with its total mass takes care of the equilibrium of mass.

Another feature of the invention resides broadly in a drive, characterized by the fact that connecting rod KO for the area of its movement end position is located in a constraint guide.

Still yet another feature of the invention resides broadly in a drive, characterized by the fact that crank KU is being utilized as part of a planetary gearing, and that on crank journal 3 and solidly connected with same is pinion 9 which rolls off an internally geared sprocket 10 which surrounds the crank KU in such a way that through the overlapping of the rotating motion of pinion and crank KU connecting rod KO receives a rotating motion in the opposite direction.

An example of a milling machine can be found in U.S. Pat. No. 4,858,458, entitled "Drive For A Pilger Cold-Rolling Mill With Balancing Of Masses And Moments". This U.S. Pat. No. 4,858,458 is not prior art since it has a U.S. filing date of Feb. 23, 1988, whereas the present application has a priority date of June 18, 1987; a large number of the various components, such as, the pilger mill, the gearing and the connecting elements, etc., are very similar, if not identical to the components of the present invention and the embodiments of the present invention operate analogously to the components of this patent even if these components may not be shown in the present application. The parts of the U.S. Pat. No. 4,858,458 relating to the mill, etc. that may or may not be shown in the present application are specifically incorporated herein by reference as if set forth in their entirety herein. The structure associated with arm 14 and arm 14 may be utilized in the present invention. Other examples of milling machines may be found in U.S. Pat. No. 4,713,955, entitled "Method Permitting The Increase Of Operations Of Cold Pilger Mills And An Apparatus For The Embodiment Of This Method"; U.S. Pat. No. 4,687,350, entitled "Sealed Bearing For Ring Roller Of Cold Pilger Rolling Mill"; U.S. Pat. No. 4,658,617, entitled "Method Permitting The Increase Of Operations Of Cold Pilger Mills And An Apparatus For The Embodiment Of This Method"; U.S. Pat. No. 4,641,513, entitled "Cold Rolling Process For Tubes By Means Of A Pilger Rolling Machine And The Rolling Mill For Its Execution"; U.S. Pat. No. 4,577,483, entitled "System For The Continuous Operation Of A Cold Pilger Rolling Mill"; U.S. Pat. No. 4,562,713, entitled "Cold Pilger Mill"; U.S. Pat. No. 4,547,082, entitled "Bearing Construction Of A Crankshaft Of A Cold Pilger Rolling Mill Or The Like"; U.S. Pat. No. 4,541,262, entitled "Process For Cold Rolling Of Tubes By Means Of A Pilger Mill And Device For Using The Process"; U.S. Pat. No. 4,445,354, entitled "Procedure And Equipment For The Manufacture Of Pipes With External And Internal Diameters Varying In Stages"; U.S. Pat. No. 4,386,512, entitled "Pilger Tube Rolling Mill"; U.S. Pat. No. 4,052,898; U.S. Pat. No. 4,037,444, entitled "Shell Feed System For A Cold Pilger Mill"; U.S. Pat. No. 4,005,595, entitled "Feeding Workpiece Apparatus For Cold Pilger Rolling Mills" and U.S. Pat. No. 3,890,821, entitled "Cold Pilger Rolling Mill And Method For The Rolling Of Tubes".

Some examples of planetary gears can be found in U.S. Pat. No. 4,388,819, entitled "Rolling Mills"; U.S. Pat. No. 3,938,865, entitled "Cageless Roller Bearings", and U.S. Pat. No. 3,888,138, entitled "Planetary Drive System For Rolls In A Mill".

In summary, the following is a comparison describing the disadvantages of the conventional, prior art DG and the advantages of the DG and PKG according to the present invention.

| Comparison: | |
|---|---|
| Conventional DG | DG and PKG according to the present invention |
| Horizontal construction requires a push or connecting tie rod | Due to the vertical and asymmetrical construction, no tie rods are required. |
| The large distance between the center of mass planes result in high stress of the bearing and journals | The mass required for the equilibrium of mass is furnished by the mass of the connecting rod. |
| Expensive bearings are required for crank connecting rod equilibrium of moment and rolling stand | The increased inertia moment of the connecting rod contributes to the improved uniformity of operation of the entire system. |
| | Center of mass of the connecting rod goes beyond point $S_{KO}$. |
| | The mass which has been reduced to point $S_{KO}$ reduces the total mass and the construction height of the connecting rod. |
| | The center of mass and moments of the connecting rod and that of the rolling stand are relatively close to each other. Therefore, the stress of the bearings and journals is reduced. |
| | By employing only one constraint guide, the requirement of accuracy for both guides relative to each other is omitted. There is no storage or discharge, respectively, of potential energy because |

-continued

| Comparison: | |
|---|---|
| Conventional DG | DG and PKG according to the present invention |
| | gravity does work in the direction of the main rotary axis. By employing PKG, the entire constraint guide may be omitted. The guidance of the connecting rod within the constraint guide is accomplished by a guide roller. The number of bearings is reduced from 12 to 5. |

One aspect of the invention refers to a drive for pilger cold rolling mills with equilibrium of mass and equilibrium of moment whereby the driven crank is connected to the rolling stand by means of a connecting rod. To achieve the compact, cost efficient embodiment for the drive with as little as possible stress, it is suggested that rolling stand (WG) is attached immediately above the crank drive (KU) and that connecting rod (KO) is immediately connected to crank journal (3) whereby the connecting rod (KO) with its total mass takes over the equilibrium of moment and the crank (KU) with its total mass takes over the equilibrium of mass. See FIG. 1*a*.

The mass required for the equilibrium of moment is provided by the connecting rod. In the prior art, the center of mass of the connecting rod was located beyond point D on the connecting rod. The total mass of the connecting rod is reduced to point $S_{KO}$ thereby allowing the dimensions of the connecting rod to be made small. Also, the rod may be constructed in a flat configuration.

A drive for a pilger cold rolling mill which includes a crankshaft and a connecting rod. The connecting rod balances or provides an equilibrium of moment of inertia while the crankshaft balances or provides an equilibrium of mass.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The invention as described hereinabove in the context of a preferred embodiment is not to be taken as limited to all of the provided details thereof, since modifications and variations thereof may be made without departing from the spirit and scope of the invention.

What is claimed is:

1. Apparatus for driving a pilger cold rolling machine along a path of travel, said apparatus comprising:

crankshaft means for supplying mechanical power to drive the pilger cold rolling machine along the path of travel;

said crankshaft means being rotatably mounted on a first rotational axis;

connecting rod means for driving the pilger cold rolling machine along the path of travel;

said connecting rod means being rotatably mounted on a second rotational axis;

said connecting rod means receiving mechanical power from, being connected to and being driven by said crankshaft means;

said connecting rod means having attachment means for connecting said connecting rod means to the pilger cold rolling machine;

guide means for guiding said attachment means and the pilger cold rolling machine along the path of travel when said connecting rod means is driven by said crankshaft means;

said connecting rod means being configured to provide a balancing of moment forces to the pilger cold rolling machine;

said connecting rod means being configured to provide a balancing of the moment of inertia of said connecting rod means and the pilger cold rolling machine; and said crankshaft means being configured to provide a balancing of mass the pilger cold rolling machine.

2. Apparatus for driving a pilger cold rolling machine along a path of travel, said apparatus comprising:

crankshaft means for supplying mechanical power to drive the pilger cold rolling machine along the path of travel;

said crankshaft means being rotatably mounted on a first rotational axis;

connecting rod means for driving the pilger cold rolling machine along the path of travel;

said connecting rod means being rotatably mounted on a second rotational axis;

said connecting rod means receiving mechanical power from, being connected to and being driven by said crankshaft means;

said connecting rod means having attachment means for connecting said connecting rod means to the pilger cold rolling machine;

guide means for guiding said attachment means and the pilger cold rolling machine along the path of travel when said connecting rod means is driven by said crankshaft means;

said connecting rod means being configured to provide an equilibrium of moment forces to the pilger cold rolling machine;

said connecting rod means being configured to provide an equilibrium of the moment of inertia of said connecting rod means and the pilger cold rolling machine; and said crankshaft means being configured to provide an equilibrium of mass to the pilger cold rolling machine.

3. Apparatus for driving a pilger cold rolling machine along a path of travel, said apparatus comprising:

crankshaft means for supplying mechanical power to drive the pilger cold rolling machine along the path of travel;

said crankshaft means being rotatably mounted on a first rotational axis;

connecting rod means for driving the pilger cold rolling machine along the path of travel;

said connecting rod means being rotatably mounted on a second rotational axis;

said connecting rod means receiving mechanical power from, being connected to and being driven by said crankshaft means;

said connecting rod means having attachment means for connecting said connecting rod means to the pilger cold rolling machine;

guide means for guiding said attachment means and the pilger cold rolling machine along the path of travel when said connecting rod means is driven by said crankshaft means;

said connecting rod means being configured to provide a balancing of moment forces to the pilger cold rolling machine;

said connecting rod means being configured to provide a balancing of the moment of inertia of said connecting rod means and the pilger cold rolling machine;

said crankshaft means being configured to provide a balancing of mass to the pilger cold rolling machine; and said first rotational axis of said crankshaft means being positioned generally at the midpoint of the path of travel of the pilger cold rolling machine.

4. The apparatus of claim 3, further including:

motor means for supplying mechanical power to said crankshaft means; and said motor means being connected to said crankshaft means.

5. The apparatus of claim 4, wherein said connecting rod means is connected to said crankshaft means with a crank journal.

6. The apparatus of claim 5, wherein the center of mass of said crankshaft means is at a position other than the geometric center of said crankshaft means.

7. The apparatus of claim 6, wherein the center of mass of said connecting rod means is at a position other than the geometric center of said connecting rod means.

8. The apparatus of claim 7, wherein said center of mass of said crankshaft means, said first rotational axis and said crank journal define a generally straight first line.

9. The apparatus of claim 8, wherein said crankshaft means defines a circular portion.

10. The apparatus of claim 9, wherein said connecting rod means defines a circular portion.

11. The apparatus of claim 10, wherein said crankshaft means and said connecting rod means rotate in opposite directions when said connecting rod means is driven by said crankshaft means.

12. The apparatus of claim 11, wherein said connecting rod means is positioned vertically below said attachment means.

13. The apparatus of claim 12, wherein at least a portion of said crankshaft means is positioned vertically below said connecting rod means.

14. The apparatus of claim 13, wherein said guide means defines slot means for guiding said attachment means and the pilger cold rolling machine to follow along the path of travel when said connecting rod means is driven by said crankshaft means.

15. The apparatus of claim 13, wherein said guide means is planetary gear means.

16. The apparatus of claim 15, wherein said planetary gear means includes at least two gears.

* * * * *

UNITED STATES PATENT AND TRADEMARK OFFICE

CERTIFICATE OF CORRECTION

PATENT NO. : 5,076,088

DATED : December 31, 1991

INVENTOR(S) : Herman Josef KLINGEN, et al.

It is certified that error appears in the above-indentified patent and that said Letters Patent is hereby corrected as shown below:

On title page, item [63], line 2,
after 'Feb.', delete "3," and insert --23,--.

In column 1, line 63, after 'as' delete " $\vec{\dot{\Phi}}$ " and insert -- $\vec{\dot{\mathcal{S}}}$ --.

In column 3, line 58, after 'respectively.' delete " $\dot{\Phi}$ " and insert -- $\dot{\mathcal{S}}$ --.

In column 3. line 58, after 'and' delete " $\Phi$ " and insert -- $\mathcal{S}$ --.

Signed and Sealed this

Fourteenth Day of March, 1995

*Attest:*

*Attesting Officer*

Bruce Lehman

BRUCE LEHMAN

*Commissioner of Patents and Trademarks*